United States Patent [19]

Sass

[11] 4,281,877

[45] Aug. 4, 1981

[54] ROCK BOLTING TECHNIQUES FOR FORMING AN IN SITU OIL SHALE RETORT

[75] Inventor: Allan Sass, Los Angeles, Calif.

[73] Assignee: Occidental Oil Shale, Inc., Grand Junction, Colo.

[21] Appl. No.: 90,634

[22] Filed: Nov. 2, 1979

[51] Int. Cl.[3] ..... E21C 41/10

[52] U.S. Cl. ..... 299/2; 299/11; 299/13; 102/311

[58] Field of Search ..... 299/2, 11, 13; 405/55, 405/259; 102/23

[56] References Cited

U.S. PATENT DOCUMENTS

| | | | |
|---|---|---|---|
| 2,846,205 | 8/1958 | Bucky | 299/11 |
| 3,917,346 | 11/1975 | Janssen | 299/13 |
| 4,036,137 | 7/1977 | Dietrich | 102/23 |

OTHER PUBLICATIONS

Mining Engineer Handbook, vol. 1, 1973, pp. 13-125 to 13-135.

*Primary Examiner*—Ernest R. Purser
*Attorney, Agent, or Firm*—Christie, Parker & Hale

[57] ABSTRACT

A subterranean formation containing oil shale is prepared for in situ retorting by forming a fragmented permeable mass of formation particles containing oil shale in an in situ oil shale retort site. Formation is initially excavated from the retort site for forming one or more voids extending horizontally across the retort site, leaving a zone of unfragmented formation adjacent such a void. In one ambodiment, an array of rocks bolts are anchored in at least a portion of the roof adjacent such a void for providing reinforcement of unfragmented formation above the void. Vertical blasting holes are drilled in the zone of unfragmented formation adjacent the void. Explosive is placed in the blasting holes and detonated for explosively expanding the zone of unfragmented formation toward the void, including the rock bolted portion of the roof, for forming at least a portion of a fragmented permeable mass of formation particles containing oil shale in an in situ oil shale retort. Surprisingly, the rock bolting does not interfere with, and in some instances can improve, fragmentation compared with comparable blasts without such rock bolts. The reinforcement provided by the rock bolts can reduce or eliminate the need for roof support pillars in horizontal voids at intermediate levels of the retort site.

22 Claims, 7 Drawing Figures

ROCK BOLTING TECHNIQUES FOR FORMING AN IN SITU OIL SHALE RETORT

BACKGROUND OF THE INVENTION

This invention relates to in situ recovery of shale oil from formation containing oil shale, and more particularly to the use of rock bolting techniques in unfragmented formation adjacent a horizontal void in a method for forming an in situ oil shale retort.

The presence of large deposits of oil shale in the Rocky Mountain region of the United States has given rise to extensive efforts to develop methods for recovering shale oil from kerogen in the oil shale deposit. It should be noted that the term "oil shale" as used in the industry is in fact a misnomer; it is neither shale, nor does it contain oil. It is a sedimentary formation comprising marlstone deposit with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material. The liquid products and the gaseous products are cooler by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to form a fragmented mass having a reasonably uniformly distributed void fraction, i.e., a fragmented mass of reasonably uniform premeability, so that retorting gas can flow generally uniformly through the fragmented mass during retorting operations. Techniques used for excavating void spaces in a retorting site and for explosively expanding formation toward the voids can affect the uniformity of particle size or permeability of the fragmented mass. A fragmented mass having reasonably uniform permeability in horizontal planes across the fragmented mass can avoid bypassing portions of the fragmented mass by retorting gas, which can otherwise occur if there is gas channelling through the fragmented mass owing to non-uniform permeability.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above the other at intermediate levels within the retort site. A plurality of vertically spaced apart zones of unfragmented formation are left between adjacent voids, and explosive is placed in blasting holes drilled in the zones of formation and detonated, preferably in a single round, to explosively expand each unfragmented zone into the horizontal voids on either side of it to form a fragmented mass. Retorting of the fragmented mass is then carried out to recover shale oil from the oil shale.

Techniques for expanding roof-supporting pillars along with horizontal zones of formation in a horizontal free face system are described in Application Ser. No. 929,250, filed July 31, 1978, now U.S. Pat. No. 4,192,554 and Application Ser. No. 951,527, filed Dec. 16, 1978 now abandoned. Those applications are owned by the assignee of this application and are incorporated herein by this reference.

In some embodiments it is necessary to leave one or more pillars within each horizontal void for providing temporary roof support for unfragmented formation overlying each void. The pillars can be explosively expanded prior to explosively expanding the unfragmented zones toward the voids. Such prior expansion of the pillars can form a reasonably continuous horizontal free face adjacent such a void. The need to form pillars and the need to explosively expand such pillars in the horizontal voids can contribute to the overall cost and complexity of mine excavation and explosive expansion operations.

SUMMARY OF THE INVENTION

This invention provides a method for forming an in situ oil shale retort in a retort site in a subterranean formation containing oil shale. Formation is excavated from within the retort site for forming at least one void extending generally horizontally across the retort site, leaving at least one zone of unfragmented formation within the retort site adjacent such a void, such a zone of unfragmented formation having a generally horizontal free face of formation adjacent such a void. An array of rock bolts are placed in at least a portion of such a free face, and explosive is placed in such a zone of unfragmented formation. The explosive is detonated for explosively expanding formation within such a zone of formation toward the horizontal free face, including toward the rock bolted portion of the free face, for forming at least a portion of a fragmented permeable mass of formation particles containing oil shale in the in situ oil shale retort. Preferably, the rock bolts are placed in a roof above such a void for providing reinforcement for unfragmented formation above such a void. A plurality of generally vertical blasting holes can be drilled in such a zone of unfragmented formation and explosive placed in the blasting holes to have a distance from the end of the explosive column remote from the free face to such a horizontal free face that is greater than the average depth of penetration of the rock bolts into the zone of unfragmented formation. The presence of the rock bolts adjacent the free face during fragmentation does not interfere with forming a fragmented mass of a desired permeability, and the presence of the rock bolts can actually enhance fragmentation.

DRAWINGS

These and other aspects of the invention will be more fully understood by referring to the following detailed description and the accompanying drawings, in which.

DETAILED DESCRIPTION

Figure 1:
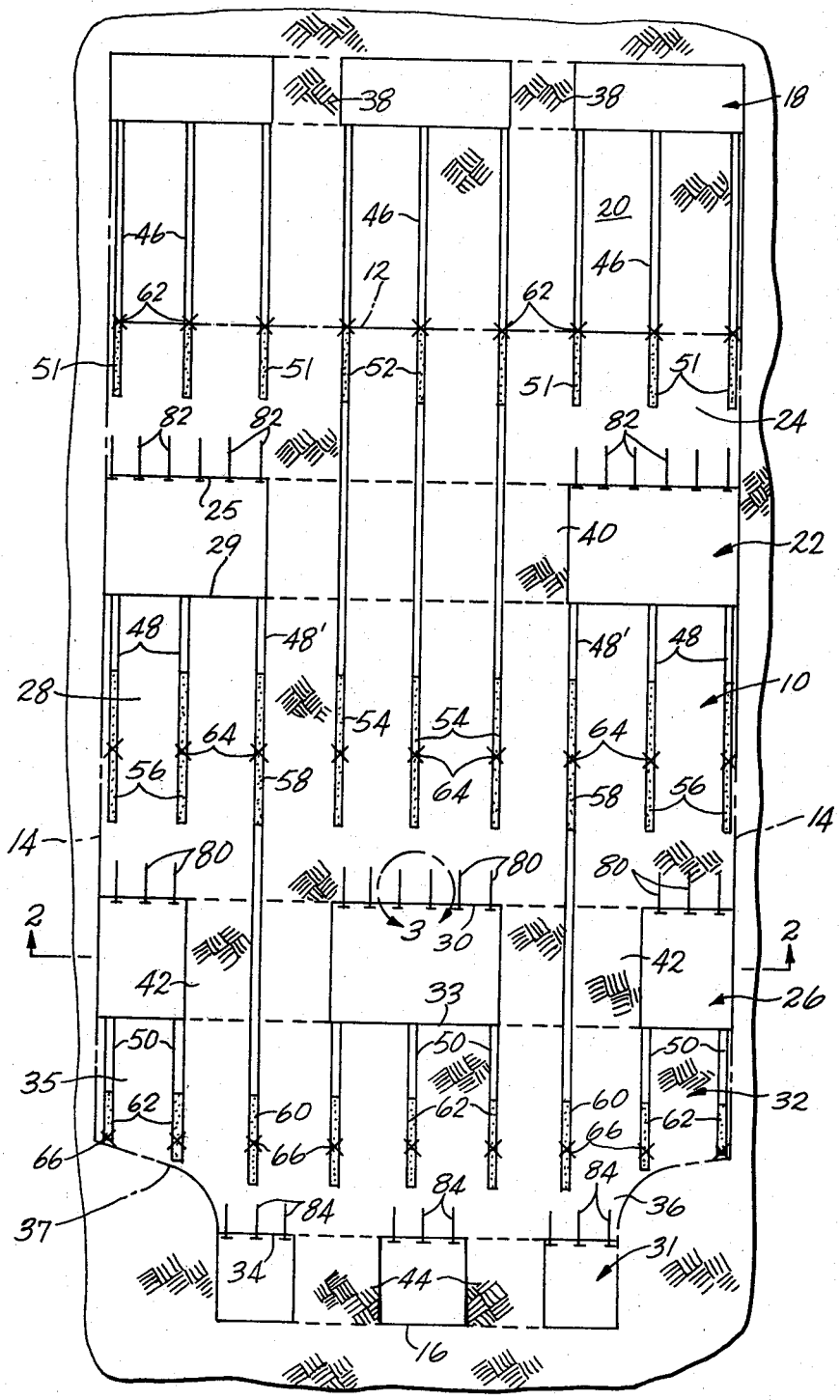
FIG. 1 is a fragmentary, semi-schematic vertical cross-sectional view showing a subterranean formation containing oil shale prepared for explosive expansion for forming an in situ retort according to principles of this invention.

FIG. 1 is a semi-schematic vertical cross-section at one stage during preparation of an in situ oil shale retort being formed in accordance with principles of this invention. The retort is being formed in a subterranean formation 10 containing oil shale. The in situ retort is preferably rectangular in horizontal cross-section, and in the illustrated embodiment the retort is square in horizontal cross-section, having a top boundary 12, four vertically extending side boundaries 14, and a lower boundary 16.

The in situ retort is formed by a horizontal free face system in which formation is excavated from within the retort site forming a plurality of vertically spaced apart voids each extending generally horizontally across a different level of the retort site, leaving zones of unfragmented formation between adjacent horizontal voids. In the illustrated embodiment, a portion of the formation within the retort site is excavated on an upper working level for forming an open base of operation 18. The floor of the base of operation is spaced above the upper boundary 12 of the retort being formed, leaving a horizontal sill pillar 20 of unfragmented formation between the floor of the base of operation and the upper boundary of the retort. The horizontal cross-sectional area of the base of operation is sufficient to provide effective access to substantially the entire horizontal cross-section of the retort being formed. The base of operation provides access for drilling and explosive loading for subsequently explosively expanding formation toward the voids formed within the retort site for forming a fragmented permeable mass of formation particles containing oil shale within the upper, side and lower boundaries of the retort being formed. The base of operation also facilitates introduction of oxygen-supplying gas into the top of the fragmented mass being formed below the sill pillar, and for this reason the base of operation can also be referred to as an air level void. The sill pillar and base of operation are shown as an example, since the invention also can be used in a retort without such a sill pillar.

In the horizontal free face system illustrated in FIG. 1, three vertically spaced apart horizontal voids are excavated within the retort site below the sill pillar. A rectangular upper void 22 is excavated at a level spaced vertically below the sill pillar, leaving an upper zone 24 of unfragmented formation extending generally horizontally across the retort site between the upper boundary 12 of the retort and a roof 25 above the upper void. The roof above the upper void also can be referred to as a generally horizontal upper free face of unfragmented formation above the upper void.

A rectangular intermediate void 26 is excavated at an intermediate level of the retort, leaving an intermediate zone 28 of unfragmented formation extending generally horizontally across the retort site between a floor 29 of the upper void 22 and a roof 30 above the intermediate void 26. The floor of the upper void also can be referred to as a horizontal lower free face below the upper void, and the roof of the intermediate void can also be referred to as a horizontal upper free face above the intermediate void. In the embodiment shown, the horizontal cross-sectional area within the side boundaries of the intermediate void is similar to that of the upper void and the intermediate void is directly below the upper void.

A production level void 31 is excavated at a lower production level of the retort, leaving a lower zone 32 of unfragmented formation extending horizontally across the retort site between a floor 33 below the intermediate void 26 and a roof 34 above the production level void. The floor of the intermediate void also can be referred to as a horizontal lower free face below the intermediate void, and the roof above the production level void can also be referred to as a horizontal upper free face above the production level void. The horizontal cross-sectional area of the upper and intermediate voids is greater than the horizontal cross-sectional area of the production level void. The lower zone of unfragmented formation includes a relatively wider upper portion 35 of substantially uniform height adjacent the floor of the intermediate void. The wider upper portion of the lower zone has a horizontal cross-sectional area similar to that of the intermediate void. The lower zone also includes a relatively narrower lower portion 36 having upwardly and outwardly tapering side boundaries 37 extending between the upper free face or roof at the production level void and the wider upper portion 35 of the lower zone.

Details relating to the overall size of the retort, the size of the voids and the zones of formation adjacent the voids, and the size of blasting holes and amounts of explosive placed in blasting holes in such zones of formation are described with respect to a similar exemplary embodiment in Applications Ser. Nos. 929,250 and 951,527 referenced above.

One or more pillars can be left within each of the horizontal voids for providing temporary roof support for the zone of unfragmented formation overlying each void. Each support pillar comprises a column of unfragmented formation integral with and extending between the roof and floor of each horizontal void. Although a number of different configurations of roof support pillars can be used, in the illustrated embodiment the air level void 18 includes a pair of laterally spaced apart, parallel, relatively long and narrow support pillars 38 extending most of the length of the air level void, forming a generally E-shaped void space within the air level void.

In the illustrated embodiment the upper void 22 includes one large roof support pillar 40 of rectangular horizontal cross-section located generally centrally within the upper void. A generally rectangular peripheral void space surrounds all four side walls of the support pillar.

The intermediate void in the same working embodiment includes a pair of laterally spaced apart, parallel, relatively long and narrow support pillars 42. A void space surrounds the entire periphery of each pillar.

The production level void in this embodiment includes a pair of laterally spaced apart, relatively long and narrow, parallel support pillars 44 extending a major part of the production level void. The support pillars form a generally E-shaped void space within the lower void.

An array of rock bolts 80 (see FIG. 1) are anchored in the roof 30 above the intermediate void 26. Similar arrays of rock bolts 82 and 84 are anchored in the roof 25 above the upper void 22 and the roof 34 above the production level void 31, respectively. Similar rock bolts also can be anchored in the roof above the base of operation if desired.

Figure 2:
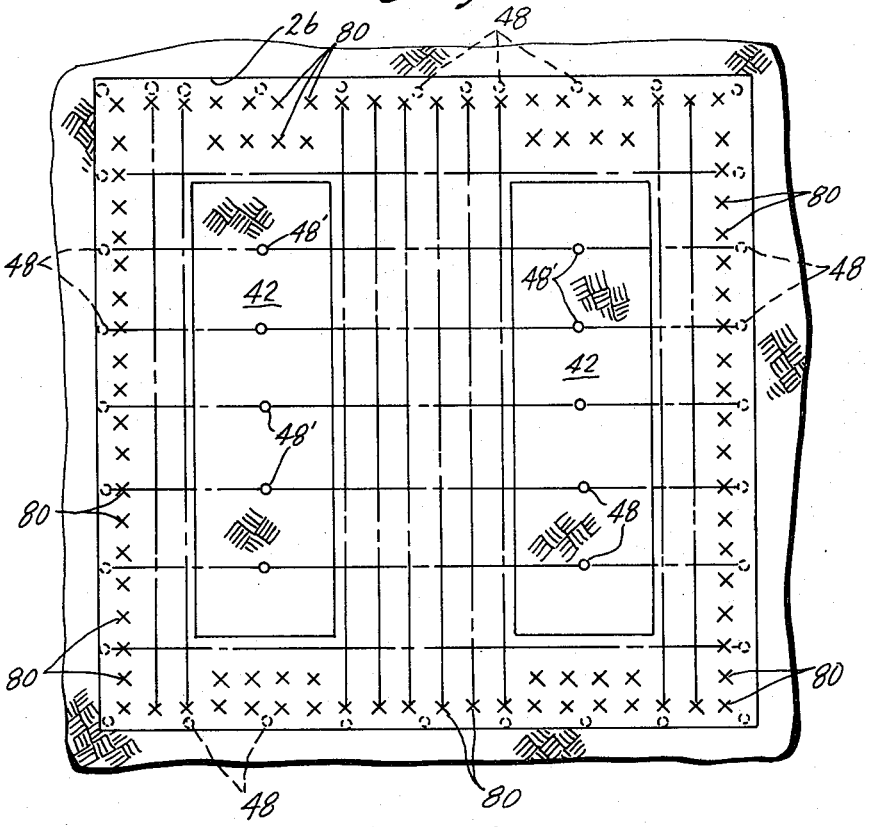
FIG. 2 is a fragmentary, semi-schematic horizontal cross-sectional view taken on line 2—2 of FIG. 1 and illustrating an arrangement of blasting holes and rock bolts used in the retort illustrated in FIG. 1.
Figure 3:
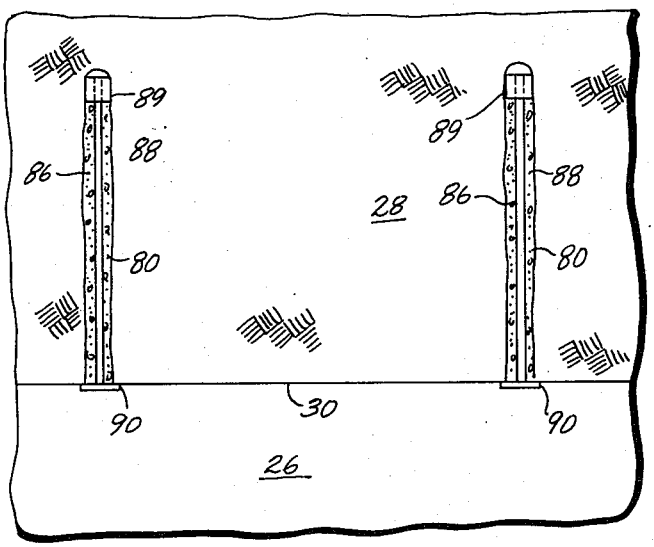
FIG. 3 is an enlarged fragmentary, semi-schematic vertical cross-sectional view of the rock bolts shown within the circle 3 of FIG. 1.

FIGS. 2 and 3 illustrate placement of the rock bolts 80 and the roof 30 of unfragmented formation above the intermediate void. The rock bolts are anchored in a square matrix pattern on eight-foot centers. The rock bolts are placed in separate holes 86 drilled generally vertically into the roof, i.e., substantially perpendicular to the horizontal free face of formation provided by the roof. The rock bolts comprise, for example, steel rods six feet long pretensioned and additionally anchored in each drill hole by grouting 88. Pretensioning devices 89 are shown embedded in the blasting holes at the ends thereof remote from the free face. A separate square steel plate 90 is affixed to the head of each rock bolt and engages the roof of the void.

The rock bolts 82 and 84 in the roof of the upper void and in the roof of the production level void can be similar to the rock bolts 80 and can be anchored in a similar manner with similar spacing.

A variety of rock bolts are available commercially for use in bolting the roof of such voids. A source, for example, is Williams Form Engineering Corporation of Grand Rapids, Mich. A rock bolt comprises a steel rod inserted in a drill hole in the rock and tightened against an expanding anchor in the far end of the hole. This pretensions the rock bolt and tends to place a compressive load on rock adjacent the drill hole. In many embodiments it is desirable to grout the rock bolt in place along its length, and in such cases a hollow bolt is used. After the rock bolt is anchored in the hole cement grout is pumped into the annulus between the bolt and hole until grout extrudes through the de-air passage through the hollow bolt indicating that the annulus is filled. Rock bolts are available in a variety of lengths up to ten feet and bolts can be assembled end-to-end to form longer lengths if desired.

Rock bolting is an accepted technique for reinforcing the peripheries of mine and tunnel openings in all types of rock. The function of the bolts is to bind together a discontinuous rock made up of a series of laminae, or a rock containing natural joints or fractures, or the outer layer of blast-fractured rock adjacent an opening excavated with explosive. The roof of a horizontal void excavated in oil shale can be such types of rock. Accompanying this application is a copy of pages 13–125 through 13–134 of *Mining Engineering Handbook*, vol. 1, 1973, published by the American Institute of Mining, Metallurgical, and Petroleum Engineers, Inc.

Referring to FIG. 1, a plurality of mutually spaced apart substantially vertical upper blasting holes 46 are drilled down from the air level void through the sill pillar 20 and into at least an upper portion of the upper zone of unfragmented formation above the upper void 22. The upper blasting holes are substantially equidistantly spaced apart in each of a plurality of rows extending across the width of the air level void. The rows of upper blasting holes are parallel to one another and the rows are substantially equidistantly spaced apart from one another from the front to the rear of the air level void, the spacing between rows being the same as the spacing between blast holes in each row. The blasting holes within each row are aligned with corresponding blasting holes in adjacent rows to form a symmetrical pattern comprising a square matrix or array of blast holes across the floor of the air level void. In an exemplary embodiment, the upper blasting holes in each row are mutually spaced apart on 20-foot centers. A portion of the upper blasting holes in the three centrally located rows are drilled down from an access region of the upper level void directly above the support pillar 40 in the upper void, and these upper blasting holes (identified by reference numeral 46') are longer than the remaining shorter upper blasting holes 46 which are drilled down from the air level void into unfragmented formation above the portion of the upper void not occupied by the support pillar 40. The longer upper blasting holes 46' are drilled down from the floor space between the two support pillars within the air level void. These longer upper blasting holes are drilled through the sill pillar, through the upper zone of unfragmented formation, through the pillar in the upper void, and through about ¾ of the depth of the intermediate zone of unfragmented formation. The remaining shorter upper blasting holes are drilled down from the air level void through the entire depth of the sill pillar and through about the upper half of the upper zone of unfragmented formation.

A plurality of mutually spaced apart vertical intermediate blasting holes 48 are drilled down from the floor of the upper void into at least a portion of the intermediate zone of unfragmented formation below the upper void. The intermediate blasting holes are drilled in a symmetrical pattern in which they are substantially equidistantly spaced apart across the width of the upper void in a square matrix or array of blasting holes similar to the upper blasting holes in the air level void. In an exemplary embodiment, the blasting holes are mutually spaced apart on 20-foot centers. A portion of the intermediate blasting holes are drilled through the support pillar in the intermediate void, and these intermediate blasting holes (identified by reference numeral 48') are longer than the remaining shorter intermediate blasting holes 48. Each of the longer intermediate blasting holes is drilled down from a floor space in the upper void immediately adjacent a corresponding outside wall of the support pillar 40 in the upper void. These longer intermediate blasting holes are drilled down from the upper void, through the entire depth of the intermediate zone of unfragmented formation, approximately through the center of the support pillars in the intermediate void, and through about ¾ of the depth of the lower zone of unfragmented formation below the intermediate void. The remaining shorter intermediate blasting holes extend through about ¾ the depth of the intermediate zone of unfragmented formation.

A plurality of mutually spaced apart vertical lower blasting holes are drilled down from the floor of the intermediate void into a portion of the lower zone of unfragmented formation below the intermediate void. The lower blasting holes can be drilled on a square matrix pattern similar to the square matrix or array of upper and intermediate blasting holes. Lower blasting holes in an outer or perimeter region of the lower zone are drilled slightly shorter in length than blasting holes in central regions of the lower zone as illustrated in FIG. 1. Blasting holes 50 in the central region of the lower zone are drilled down from the open floor space in the intermediate void between the pillars in the intermediate void, extending through about ¾ the depth of the lower zone of unfragmented formation. The lower portion of each longer intermediate blasting hole 48' is drilled through a pillar 42 in the intermediate void and into the lower zone of unfragmented formation to a depth about ¾ the depth of the lower zone. The two outer rows of blasting holes in the lower zone terminate near the bottom boundary 37 of the fragmented mass being formed which tapers slightly downwardly and inwardly to provide a slightly sloping step.

The blasting holes are loaded with vertical columns of explosive and such explosive is detonated in a single round to explosively expand formation within the upper, intermediate and lower zones of unfragmented formation toward the upper, intermediate and lower voids for forming a fragmented permeable mass of formation particles containing oil shale in the in situ retort being formed. To more clearly illustrate placement of explosive and stemming in the blasting holes, the blasting holes are shown out of proportion in FIG. 1, i.e., the diameter of the blasting holes is actually much smaller in relation to the horizontal dimensions of the retort than is shown in FIG. 1. In the illustrated embodiment, a lower portion of the short upper blasting holes 46 are loaded with separate columns of explosive 51 up to the top of the upper zone of unfragmented formation, and the top portions of the short upper blasting holes through the sill pillar are stemmed with an inert material such as sand or gravel. The columns of explosive in the short upper blasting holes extend through approximately the upper half of the upper zone of unfragmented formation. Similarly, the longer upper blasting holes are loaded with explosive columns 52 extending through approximately the upper half of the upper zone of unfragmented formation. These same vertical blasting holes have vertical columns of explosive 54 extending through approximately the central half of the intermediate zone of unfragmented formation. The short intermediate blasting holes are loaded with separate columns 56 of explosive extending through approximately the middle half of the intermediate zone of unfragmented formation. The longer intermediate blasting holes 48 are loaded with columns of explosive 58 which also extend through approximately the middle half of the intermediate zone of unfragmented formation. These same blasting holes also contain explosive charges 60 extending through approximately the middle half of the lower zone of unfragmented formation. Vertical column charges of explosive 62 are placed in lower portions of the shorter lower blasting holes 50 for occupying approximately the lower half of the lower zone of unfragmented formation near its perimeter. Remaining portions of the blasting holes not containing such explosive charges are stemmed.

In the illustrated embodiment, the burden distance to each of the upper and lower horizontal free faces of formation adjacent the upper void is substantially the same. The burden distance is measured vertically from the centroid of each column of explosive to the nearest free face. In the intermediate zone of unfragmented formation, half of the formation is explosively expanded upwardly toward the upper void and the lower half is explosively expanded downwardly toward the intermediate void. The half of each column of explosive above the central plane of the intermediate zone is effective for expanding formation toward the upper void and the lower half expands formation toward the intermediate void. The effective centroid of each column of explosive expanding formation toward an adjacent void is the same distance from one adjacent free face as the distance from the other adjacent free face.

In the upper zone of unfragmented formation, detonation of each explosive charge is initiated at the end of the column of explosive farthest from the free face toward which formation is explosively expanded when the explosive is detonated. When so detonated, the direction of propagation of detonation through the explosive is toward the free face. Separate detonators (represented by an X at 62 in FIG. 1) are placed in the blasting holes in the upper zone of unfragmented formation. Each of these detonators is therefore at the same level, namely, at the top of the upper zone of unfragmented formation, approximately 35 feet from the upper free face adjacent the upper void. Detonation of explosive in the upper blasting holes is initiated such that the direction of propagation of detonation is toward the upper free face adjacent the upper void.

In the intermediate zone of unfragmented formation separate detonators (represented by an X at 64 in FIG. 1) are placed in the center of each column of explosive in the intermediate zone for initiating detonation of such explosive upwardly toward the upper void and downwardly toward the lower void. These detonators are positioned at a level approximately mid-way between the lower free face of formation adjacent the upper void and the upper free face of formation adjacent the lower void.

Separate detonators (represented by an X at 66 in FIG. 1) are placed at about the same level in the columns of explosive in the lower zone of unfragmented formation, Detonation of explosive in the lower blasting holes is initiated such that the direction of propagation of detonation is upwardly toward the lower free face adjacent the intermediate void. Detonation of explosive in portions of the lower blasting holes above the production level void propagates toward the free face at the roof of the production level void for explosive expansion of formation within the lower portion of the lower zone toward the production level void.

Explosive also is placed in the support pillars in the upper, intermediate and lower voids. Horizontally extending blasting holes (not shown) can be drilled in the pillars and such blasting holes loaded with explosive for being detonated for explosively expanding the pillars. Various arrangements of horizontal blasting holes can be used depending upon the size and shape of the pillars. Alternatively, the vertical blasting holes shown in FIG. 1 can be loaded with explosive charges for expanding the pillars. It is desirable to detonate explosive in the pillars shortly before detonating explosive in the zones of unfragmented formation within the retort site so that the pillars do not interfere with explosive expansion of the zones of unfragmented formation.

Following explosive loading within the retort site, explosive in the blasting holes is detonated in a single round of explosions for forming a fragmented permeable mass 70 (see FIG. 7) of formation particles containing oil shale. In explosively expanding formation for forming the in situ retort, explosive charges 51 in the lower portions of the upper blasting holes 46 explosively expand at least a portion of formation within the upper zone 24 of unfragmented formation downwardly toward the horizontal free face of formation provided by the rock-bolted portion of the roof 25 above the upper void 22. Similarly, explosive charges 56 in lower portions of the blasting holes 48 explosively expand at least a portion of formation within the intermediate zone 28 of unfragmented formation downwardly toward the horizontal free face of formation provided by the rock-bolted portion of the roof 30 above the intermediate void 26; and explosive charges 62 in lower portions of the blasting holes 50 and explosive charges 60 in lower portions of the blasting holes 48' explosively expand at least a portion of formation within the lower zone 32 of unfragmented formation downwardly toward the horizontal free face of formation provided by the rock-bolted portion of the roof 34 above the production level void 31.

The distance from the roof 25 of the intermediate void to the ends of the explosive charges closest to the free face provided by the roof is greater than, preferably twice as great as, the depth of penetration of the rock bolts into the unfragmented formation adjacent the roof. Stated another way, the bottoms of the explosive columns 51 are preferably at least twice as far from the horizontal free face provided by the roof of the intermediate void than the depth of penetration of the rock bolts 82 into formation adjacent the roof. The burden distance of the explosive columns 52 to the roof 25 is at least three times greater than the average depth of penetration of the rock bolts 82 into formation adjacent the roof. Similarly, portions of the explosive columns 56 located closest to the free face provided by the roof 30 of the lower intermediate void are located a greater distance, preferably at least twice the distance, from the roof than the depth of penetration of the rock bolts 80 into formation adjacent the roof; the burden distance to the roof 30 of the explosive columns 56 is at least three times greater than the depth of penetration of the rock bolts 80 into formation adjacent the roof; portions of the explosive charges 60 and 62 closest to the free face provided by the roof 34 of the production level void are located at least twice the distance from the roof than the depth of penetration of the rock bolts 84 into unfragmented formation adjacent the roof; and the burden distance of these explosive charges 60 and 62 to the free face provided by the roof 34 of the production level void is at least three times greater than the depth of penetration of the rock bolts 84 into formation adjacent the roof.

Figure 4:
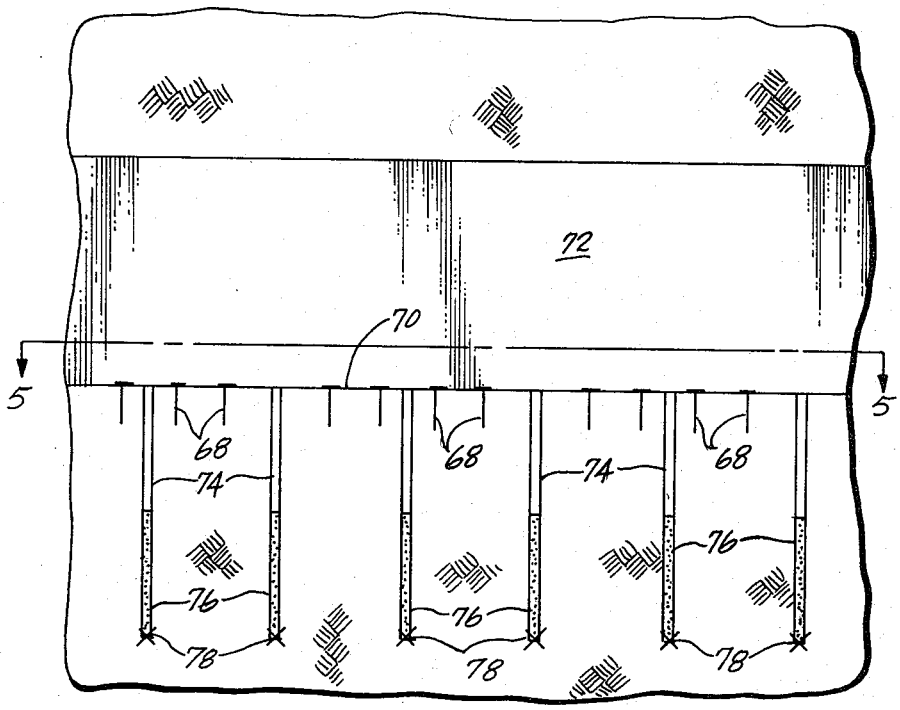
FIG. 4 is a fragmentary, semi-schematic vertical cross-sectional view taken on line 4—4 of FIG. 5 and illustrating an experiment conducted to determine effects of rock bolting techniques according to principles of this invention.
Figure 5:
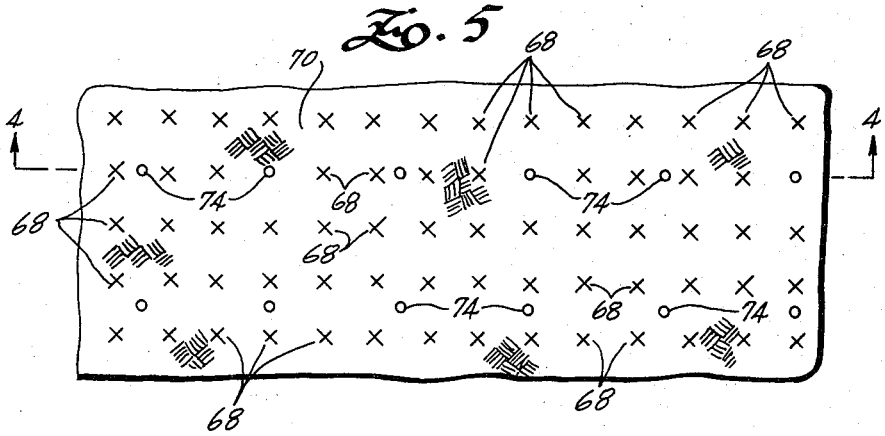
FIG. 5 is a fragmentary, semi-schematic horizontal cross-sectional view taken on line 5—5 of FIG. 4.

To determine whether the rock bolts would interfere with fragmentation of formation during subsequent detonation of explosive for forming a fragmented mass, experimental blasting tests were conducted to determine whether the rock bolts had any effect on such fragmentation. FIGS. 4 and 5 illustrate an exemplary one-quarter scale test in which an array of rock bolts 68 were anchored in a floor 70 of a zone 71 of unfragmented oil shale formation adjacent a generally horizontal drift 72. The rock bolts were one and one-half feet long and were arranged in a square matrix pattern with two-foot spacing between adjacent rock bolts. The square matrix pattern is best illustrated in FIG. 5 in which each rock bolt is represented by an X for clarity.

An array of generally vertical blasting holes 74 were each drilled to a depth of ten feet in the floor of the drift on a square matrix pattern with five-feet spacing between blasting holes. The blasting holes were loaded with separate columns of explosive 76, and the remaining upper portions of the blasting holes were stemmed. Thus, the depth of the blasting holes was substantially greater than the depth of penetration of the rock bolts in the zone of unfragmented formation 71 adjacent the rock-bolted free face 70. The explosive charges in the blasting holes also extended to a depth substantially greater than the depth of the rock bolts. The burden distance of the explosive charges from the free face 70 also was substantially greater than the depth of penetration of the rock bolts. The explosive charges 76 loaded in the blasting holes 74 of the test had the same scaled depth of burial as the explosive charges to be used in blasting toward the upper and lower free faces of the upper and intermediate voids 22 and 26 in the retort of FIG. 1. The scaled depth of burial of an explosive charge is a measure of the ability of the explosive charge or array of charges to explosively expand rock and can be expressed in units of distance over weight, or preferably energy, of the explosive to the one-third power ($d/w^{\frac{1}{3}}$). The distance (referred to as burden distance) in the equation for scaled depth of burial is measured from the free face to the effective centroid of the explosive. The weight or energy is the total for the charge of explosive.

Separate detonators (represented by an X at 78) were placed at the bottoms of the explosive charges in the blasting holes. Detonation of explosive in the blasting holes was initiated such that the direction of propagation of detonation was upwardly toward the horizontal free face 70 adjacent the drift for explosively expanding the zone 71 of unfragmented formation upwardly toward the rock-bolted portion of the free face for forming a fragmented permeable mass of formation particles containing oil shale. Two separate tests were conducted with blasting arrangements similar to FIGS. 4 and 5. After each blast, the entire volume of fragmented formation particles was excavated, and no unbroken regions were found. Fragmentation occurred to the full depth of the blasting holes. High-speed photographs were taken during blasting, and no adverse effect analogous to bending of a beam was observed. Despite the reinforcement of the formation by the rock bolts, no adverse effect on explosive expansion was noted. Particle size was as good and in some instances better than particle size in comparable tests without rock bolts. The one-quarter scale test in the floor of the drift is considered a more severe test of blasting toward a rock-bolted free face than a test in which blasting is toward a rock-bolted roof because of the possible adverse effect of gravity.

It is believed that fragmentation can be enhanced by the presence of the rock bolts because the resulting strengthening of formation prevents early venting of the gas from the explosive, producing more "gas push" and thereby better fragmentation. The rock bolts also produce a non-uniform distribution of tension between the rock bolts and the formation being explosively expanded toward the void. The rock bolts put some of the formation in compression, while between the rock bolts there can be tension or a lower level of compression than at the rock bolts. This can help fragmentation since the tension induced in the formation upon detonation of the explosive, since it is not uniformly distributed between the rock bolts, can offer a level of resistance to the venting of gas from the explosive and produce a more desirable pattern of fragmentation of formation than in the absence of such rock bolts. Thus, it can be desirable to place rock bolts in the floor of the voids as well as rock bolts in the roof for enhancing fragmentation of formation explosively expanded toward such voids.

The rock bolting techniques also can eliminate the need for roof-supporting pillars in voids on intermediate levels of a retort site. One of the elements of a horizontal free face mining system that contributes significantly to the overall cost as well as the complexity of the mining and fragmentation operations is the need to mine out voids and fragment the roof-supporting pillars on the intermediate levels. Based on the fragmentation tests conducted with respect to the rock bolting techniques herein, an in situ oil shale retort can be formed with horizontal voids on the intermediate levels with a substantial absence of roof-supporting pillars.

Figure 6:
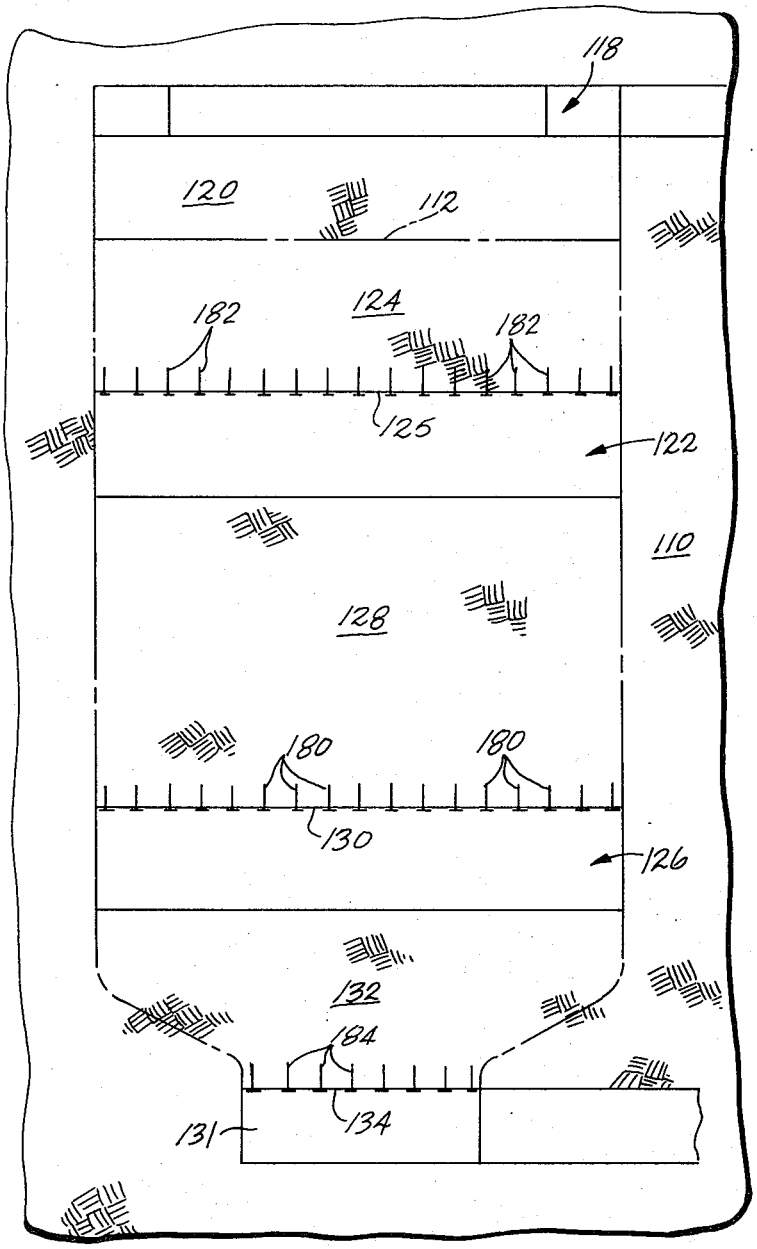
FIG. 6 is a fragmentary, semi-schematic vertical cross-sectional view illustrating an alternative embodiment of a subterranean formation containing oil shale prepared for explosive expansion according to principles of this invention.

FIG. 6 illustrates an in situ oil shale retort similar to that of FIG. 1, wherein reference numerals in FIG. 6 with 100 added correspond to similar elements of the retort of FIG. 1. The retort of FIG. 6 is formed by excavating an upper level void 122 and an intermediate level void 126 extending horizontally across substantially the entire width of the retort site. Separate zones of unfragmented formation 124 and 128 overlie the upper and intermediate voids. A lower zone of unfragmented formation 132 tapers downwardly toward a horizontal lower void 131 at the production level. In the retort of FIG. 6, the upper intermediate and production level voids have no roof-supporting pillars. An array of rock bolts 180 are anchored in the roof 130 above the intermediate void, and similarly, an array of rock bolts 182 are anchored in the roof 125 above the upper void 122, and a separate array of rock bolts 184 is anchored in the roof 134 above the production level void 131. The rock bolting strengthens the roof above each void sufficiently to avoid roof-supporting pillars, or at least minimize the need for such pillars in the horizontal voids within the retort site. It is believed that with the use of rock bolts anchored in an array over substantially the entire horizontal free face of each void, as illustrated in FIG. 6, a horizontal void width on the order of 150 feet, and possibly more can be achieved. It is also believed possible that such rock bolting of the roof of an intermediate void can allow safe excavation of voids at intermediate levels of the retort site with void heights of 50 feet or greater. This can enable a reduction of the number of intermediate voids required for a given retort height, and also may result in improved and more efficient fragmentation due to the greater depth of burial possible for the explosive charges for explosive expansion toward such a void.

Figure 7:
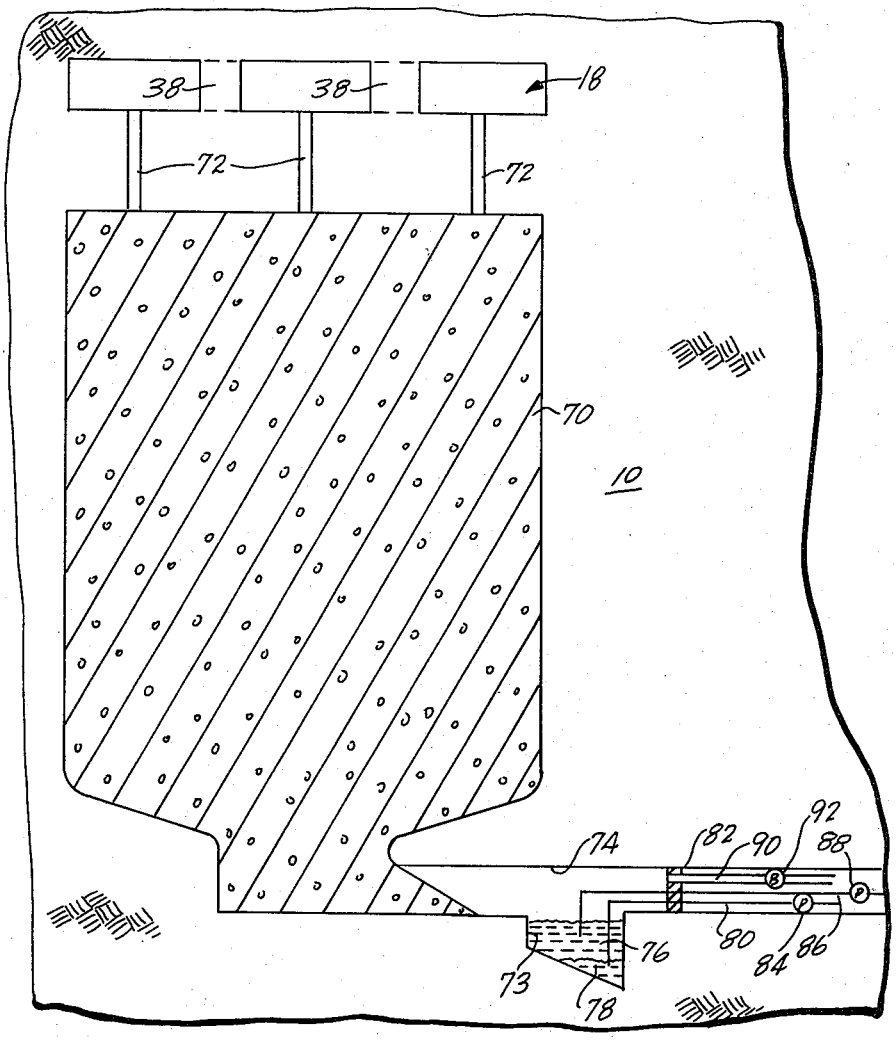
FIG. 7 is a fragmentary, semi-schematic vertical cross-sectional view illustrating completion of the in situ oil shale retort.

Following explosive expansion for forming the fragmented mass 70 illustrated in FIG. 7, retorting operations are conducted within the fragmented mass by initially igniting formation particles at the top of the fragmented mass to establish a combustion zone at the top of the fragmented mass. Air or other oxygen-supplying gas supplied to the combustion zone from the air level drift 18 through vertical air passages 72 sustains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves down through the fragmented mass, liquid and gaseous products are released from the fragmented formation particles. A sump 73 in the portion of a production level drift 74 beyond the fragmented mass collects liquid products, namely, shale oil 76 and water 78 produced during operation of the retort. A water withdrawal line 80 extends from near the bottom of the sump out through a sealed opening in a bulkhead 82 sealed across the production level drift. The water withdrawal line is connected to a water pump 84. An oil withdrawal line 86 extends from an intermediate level of the sump out through a sealed opening in the bulkhead and is connected to an oil pump 88. The water and oil pumps can be operated manually or by automatic controls (not shown) to remove shale oil and water separately from the sump. Off gas is withdrawn from behind the bulkhead by an off gas line 90 sealed through the bulkhead and connected to a blower 92.

Although described and illustrated herein with respect to certain presently preferred embodiments, this invention can be practiced other than as specifically described. Thus, for example, principles of this invention can be applied for explosively expanding formation toward a vertically extending free face wherein rock bolts are secured in formation adjacent such a free face. Many other modifications and variations will be apparent to one skilled in the art.

What is claimed is:

1. A method for recovering liquid and gaseous products from an in situ oil shale retort formed in a retort site in a subterranean formation containing oil shale, such an in situ oil shale retort containing a fragmented permeable mass of formation particles containing oil shale, the method comprising the steps of:

excavating formation from within the retort site for forming at least one void extending generally horizontally across the retort site, leaving at least one zone of unfragmented formation within the retort site below such a void, such a zone of unfragmented formation having a generally horizontal free face of formation forming a floor of such a void;

placing a plurality of rock bolts in at least a portion of the unfragmented formation having said horizontal free face of formation forming the floor of such a void;

placing explosive in such a zone of unfragmented formation;

detonating such explosive for explosively expanding formation within such a zone of unfragmented formation upwardly toward said horizontal free face of formation, including toward the rock bolted portion of the free face, for forming a fragmented permeable mass of formation particles containing oil shale in an in situ oil shale retort;

establishing a retorting zone in the fragmented mass;

introducing a retorting gas to the fragmented mass for sustaining the retorting zone and for advancing the retorting zone through the fragmented mass; and withdrawing liquid and gaseous products of retorting from the fragmented mass on the advancing side of the retorting zone.

2. The method according to claim 1 in which the length of the rock bolts extends generally perpendicular to the horizontal free face.

3. A method for recovering liquid and gaseous products from an in situ oil shale retort formed in a retort site in a subterranean formation containing oil shale, such an in situ oil shale retort containing a fragmented permeable mass of formation particles containing oil shale formed within upper, lower and side boundaries of the retort, the method comprising the steps of:

excavating formation from within the retort site for forming at least one void extending generally horizontally across the retort site, leaving at least one zone of unfragmented formation within the retort site adjacent such a void, such a zone of unfragmented formation having a generally horizontal free face of formation adjacent such a void; and wherein the horizontal cross-section of the horizontal void is similar to the horizontal cross-section of the fragmented mass being formed within the side boundaries of the retort;

placing a plurality of rock bolts in unfragmented formation adjacent such a horizontal free face of formation, said rock bolts being placed in an array distributed across essentially the entire horizontal cross-section of the horizontal void which extends to the side boundaries of the retort;

placing explosive in such a zone of unfragmented formation;

detonating such explosive for explosively expanding formation within such a zone of unfragmented formation toward the rock bolted horizontal cross-section of the horizontal free face for forming a fragmented permeable mass of formation particles containing oil shale in an in situ oil shale retort;

establishing a retorting zone in the fragmented mass;

introducing a retorting gas to the fragmented mass for sustaining the retorting zone and for advancing the retorting zone through the fragmented mass; and withdrawing liquid and gaseous products from the fragmented mass on the advancing side of the retorting zone.

4. A method for forming an in situ oil shale retort in a retort site in a subterranean formation containing oil shale, such an in situ oil shale retort containing a fragmented permeable mass of formation particles containing oil shale, comprising the steps of:

excavating formation from within the retort site for forming at least one void extending horizontally across the retort site, leaving a zone of unfragmented formation within the retort site above such a void, such a zone of unfragmented formation providing a roof of unfragmented formation above such a void;

placing an array of rock bolts in at least a portion of said roof;

placing explosive in such a zone of unfragmented formation above the roof wherein the burden distance of the explosive to the roof is greater than the depth of penetration of the rock bolts into formation adjacent the roof; and detonating such explosive for explosively expanding formation from such a zone of unfragmented formation toward the free face provided by the roof, including toward the rock bolted portion of the roof, for forming a fragmented permeable mass of formation particles containing oil shale in an in situ oil shale retort.

5. The method according to claim 4 wherein the length of the rock bolts extends substantially perpendicular to the roof.

6. The method according to claim 4 including placing a sufficient number of rock bolts in the roof to excavate such a void without roof-supporting pillars.

7. The method according to claim 6 in which the horizontal free face comprises a roof above such a void.

8. A method for forming an in situ oil shale retort in a retort site in a subterranean formation containing oil shale, such an in situ oil shale retort containing a fragmented permeable mass of formation particles containing oil shale, comprising the steps of:

excavating formation from within the retort site for forming at least one void extending horizontally across the retort site, leaving a zone of unfragmented formation within the retort site above such a void, such a zone of unfragmented formation providing a roof of unfragmented formation above such a void;

placing an array of rock bolts in at least a portion of said roof;

placing explosive in an array of column charges distributed across the horizontal cross section of such a zone of unfragmented formation above the roof, the distance from the ends of the column charges to the roof being greater than the depth of penetration of the rock bolts into formation adjacent the roof; and detonating such explosive for explosively expanding formation from such a zone of unfragmented formation toward the free face provided by the roof, including toward the rock bolted portion of the roof, for forming a fragmented permeable mass of formation particles containing oil shale in an in situ oil shale retort.

9. The method according to claim 8 in which the distance from the ends of the column charges to the roof is at least twice the depth of penetration of the rock bolts into formation adjacent the roof.

10. A method for forming an in situ oil shale retort in a retort site in a subterranean formation containing oil shale, such an in situ oil shale retort containing a fragmented permeable mass of formation particles containing oil shale, comprising the steps of:

excavating formation from within the retort site for forming at least one void extending generally horizontally across the retort site, leaving at least one zone of unfragmented formation within the retort site adjacent such a void, such a zone of unfragmented formation having a generally horizontal free face of formation adjacent such a void;

placing an array of rock bolts in unfragmented formation adjacent at least a portion of such a horizontal free face;

drilling a plurality of generally vertical blasting holes in such a zone of unfragmented formation;

placing explosive in the blasting holes, such explosive having a burden distance to such a horizontal free face that is greater than the depth of penetration of the rock bolts into such zone of unfragmented formation; and detonating such explosive for explosively expanding formation within such zone of unfragmented formation, including the rock bolted portion of the unfragmented formation, toward said horizontal free face of formation, for forming a fragmented permeable mass of formation particles containing oil shale in an in situ oil shale retort.

11. The method according to claim 1 in which such explosive has a burden distance to the horizontal free face that is at least three times as great as said depth of penetration of the rock bolts into the zone of unfragmented formation.

12. A method for forming an in situ oil shale retort in a retort site in a subterranean formation containing oil shale, such an in situ oil shale retort containing a fragmented permeable mass of formation particles containing oil shale, comprising the steps of:

excavating at least one void extending horizontally across the retort site, leaving at least one zone of unfragmented formation within the retort site adjacent such a void, such a zone of unfragmented formation having a generally horizontal free face of formation adjacent such a void, such a void having a horizontal dimension similar to the width of the fragmented mass being formed, such a void being formed in the absence of a roof-supporting pillar;

placing an array of rock bolts in unfragmented formation adjacent at least a portion of such a horizontal free face of formation;

placing explosive in such zone of unfragmented formation; and detonating such explosive for explosively expanding formation within such zone of formation toward said horizontal free face, including toward the rock bolted portion of the free face, for forming a fragmented permeable mass of formation particles containing oil shale in an in situ oil shale retort.

13. The method according to claim 12 in which the rock bolts extend generally perpendicular to the free face.

14. The method according to claim 12 in which the horizontal free face of formation provides a roof above such a void and the rock bolts are placed in said roof.

15. The method according to claim 12 including placing explosive in the zone of unfragmented formation above the roof by drilling a plurality of generally vertical blasting holes in such zone of unfragmented formation, placing explosive in the blasting holes, such explosive having a burden distance to the roof that is at least three times greater than the depth of penetration of the rock bolts into the zone of unfragmented formation.

16. The method according to claim 15 in which the blasting holes are mutually spaced apart in an array across the zone of unfragmented formation, and the average spacing between such blasting holes is greater than the average spacing between the rock bolts.

17. A method for forming an in situ oil shale retort in a retort site in a subterranean formation containing oil shale, such an in situ oil shale retort containing a fragmented permeable mass of formation particles containing oil shale and having upper, lower and side boundaries, comprising the steps of:

excavating formation within the boundaries of the retort site for forming at least one void and leaving a zone of unfragmented formation within the boundaries of the retort site adjacent such a void, the unfragmented formation having a free face adjacent such void;

placing an array of rock bolts in at least a portion of the unfragmented formation adjacent such a free face;

placing explosive in the zone of unfragmented formation with a burden distance at least three times greater than the depth of penetration of the rock bolts into the zone of unfragmented formation adjacent the free face; and detonating such explosive for explosively expanding the zone of unfragmented formation toward the free face, including the portion containing the array of rock bolts, for forming a fragmented permeable mass of formation particles containing oil shale in an in situ oil shale retort.

18. A method for forming an in situ oil shale retort in a retort site in a subterranean formation containing oil shale, such an in situ oil shale retort containing a fragmented permeable mass of formation particles containing oil shale and having upper, lower and side boundaries, comprising the steps of;

excavating formation within the boundaries of the retort site for forming at least one void extending generally horizontally across the entire horizontal cross section within the side boundaries of the retort being formed, and leaving a zone of unfragmented formation within the boundaries of the retort site adjacent such a void, the unfragmented formation having a free face adjacent such void;

placing a sufficient array of rock bolts in at least a portion of the unfragmented formation adjacent such a free face that the void can be excavated without leaving roof-supporting pillars of unfragmented formation within the side boundaries of the retort site;

placing explosive in the zone of unfragmented formation; and detonating such explosive for explosively expanding the zone of unfragmented formation toward the free face, including the portion containing the array of rock bolts, for forming a fragmented permeable mass of formation particles containing oil shale in an in situ oil shale retort.

19. A method for forming an in situ oil shale retort in a retort site in a subterranean formation containing oil shale, such an in situ oil shale retort containing a fragmented permeable mass of formation particles containing oil shale and having upper, lower and side boundaries, comprising the steps of:

excavating formation within the boundaries of the retort site for forming at least one void and leaving a zone of unfragmented formation within the boundaries of the retort site adjacent such a void, the unfragmented formation having a free face adjacent such void;

placing an array of rock bolts in at least a portion of the unfragmented formation adjacent such a free face;

placing explosive in the zone of unfragmented formation by drilling generally vertical blasting holes in the zone of unfragmented formation and placing column charges of explosive in such blasting holes, the burden distance of such explosive charges being at least three times greater than the depth of penetration of the rock bolts into unfragmented formation adjacent the free face; and detonating such explosive for explosively expanding the zone of unfragmented formation toward the free face, including the portion containing the array of rock bolts, for forming a fragmented permeable mass of formation particles containing oil shale in an in situ oil shale retort.

20. A method for forming an in situ oil shale retort in a retort site in a subterranean formation containing oil shale, such an in situ oil shale retort containing a fragmented permeable mass of formation particles containing oil shale and having upper, lower and side boundaries, comprising the steps of:

excavating formation within the boundaries of the retort site for forming at least one void and leaving a zone of unfragmented formation within the boundaries of the retort site adjacent such a void, the unfragmented formation having a free face adjacent such void;

placing an array of rock bolts in at least a portion of the unfragmented formation adjacent such a free face;

drilling a plurality of blasting holes in such zone of unfragmented formation perpendicular to the free face;

placing explosive in the blasting holes, such explosive having a burden distance to the free face that is at least three times greater than the depth of penetration of the rock bolts into the zone of unfragmented formation; and detonating such explosive for explosively expanding the zone of unfragmented formation toward the free face, including the portion containing the array of rock bolts, for forming a fragmented permeable mass of formation particles containing oil shale in an in situ oil shale retort.

21. The method according to claim 20 in which the blasting holes are mutually spaced apart in an array across the zone of unfragmented formation, and the average spacing between such blasting holes is greater than the average spacing between the rock bolts.

22. A method for forming an in situ oil shale retort in a retort site in a subterranean formation containing oil shale, such an in situ oil shale retort containing a fragmented permeable mass of formation particles containing oil shale and having upper, lower and side boundaries, comprising the steps of:

excavating formation within the boundaries of the retort site for forming at least one void and leaving a zone of unfragmented formation within the boundaries of the retort site adjacent such a void, the unfragmented formation having a free face adjacent such void;

placing an array of rock bolts in at least a portion of the unfragmented formation adjacent such a free face;

placing a plurality of columnar explosive charges in the zone of unfragmented formation perpendicular to the free face, the distance from the ends of the column charges to the roof being at least twice the depth of penetration of the rock bolts into formation adjacent the roof; and detonating such explosive for explosively expanding the zone of unfragmented formation toward the free face, including the portion containing the array of rock bolts, for forming a fragmented permeable mass of formation particles containing oil shale in an in situ oil shale retort.

* * * * *

UNITED STATES PATENT AND TRADEMARK OFFICE

CERTIFICATE OF CORRECTION

PATENT NO. : 4,281,877

DATED : August 4, 1981

INVENTOR(S) : Allan Sass

It is certified that error appears in the above—identified patent and that said Letters Patent is hereby corrected as shown below:

In the abstract, line 8, "rocks" should read -- rock --. Column 1, line 68, "cooler" should read -- cooled --. Column 2, line 1, "cooled" should read -- cooler --. Column 9, line 14, after "formation" change "," to -- . --. Column 15, line 40, claim 11, "claim 1" should read -- claim 10 --.

Signed and Sealed this

*Twenty-third* Day of *February 1982*

[SEAL]

*Attest:*

GERALD J. MOSSINGHOFF

*Attesting Officer*

*Commissioner of Patents and Trademarks*